United States Patent [19]

Lueth

[11] Patent Number: 4,554,441

[45] Date of Patent: Nov. 19, 1985

[54] ELECTRIC HEATING COIL

[75] Inventor: Roy C. Lueth, St. Clair, Mich.

[73] Assignee: Ultra-Temp Corporation, Mt. Clemens, Mich.

[21] Appl. No.: 703,182

[22] Filed: Feb. 19, 1985

Related U.S. Application Data

[62] Division of Ser. No. 567,769, Jan. 3, 1984, Pat. No. 4,512,558.

[51] Int. Cl.[4] ..... H05B 3/10

[52] U.S. Cl. ..... 219/552; 219/406; 219/541; 373/133; 373/134; 338/326

[58] Field of Search ..... 219/270, 390, 406, 408, 219/523, 539, 541, 552, 553; 373/117, 127, 128, 132, 133, 134; 338/295, 326, 333

[56] References Cited

U.S. PATENT DOCUMENTS

| | | | |
|---|---|---|---|
| 3,004,090 | 10/1961 | Donovan et al. | 373/133 X |
| 3,395,241 | 7/1968 | Roman | 219/390 X |
| 3,984,616 | 10/1976 | Beck | 373/134 |
| 4,126,757 | 11/1978 | Smith, Jr. et al. | 373/133 |
| 4,132,886 | 1/1979 | Blodgett et al. | 219/523 |
| 4,467,185 | 8/1984 | Moritoki et al. | 219/539 |
| 4,503,319 | 3/1985 | Moritoki et al. | 219/390 |

*Primary Examiner*—Volodymyr Y. Mayewsky
*Attorney, Agent, or Firm*—Gifford, Van Ophem, Sheridan & Sprinkle

[57] ABSTRACT

A delivery system is provided for use in conjunction with the metalurgical furnace of the type having an elongated furnace chamber with an access door at one end for delivering a coffin containing parts into the interior of the furnace chamber. The delivery system comprises a plurality of rollers which are secured to the bottom of the furnace chamber so that axes of the rollers extend transversely with respect to the axis of the furnace chamber. In use, the rollers frictionally engage the bottom of the coffin and guide the coffin into the furnace chamber. Preferably, the coffin includes upwardly extending channels on its bottom, and which the rollers are positioned.

1 Claim, 4 Drawing Figures

ELECTRIC HEATING COIL

This is a division of application Ser. No. 567,769 filed Jan. 3, 1984 now U.S. Pat. No. 4,512,558.

BACKGROUND OF THE INVENTION

I. Field of the Invention

The present invention relates to a coffin delivery system for metallurgical furnace.

II. Description of the Prior Art

Metallurgical furnaces of the type for sintering and other heat treatment of powdered metals, ceramics and the like, such as carbide, typically comprise an elongated furnace chamber surrounded by a pressure vessel. A door or hatch provides access to at least one and often time both ends of the furnace chamber and through which the parts to be processed are positioned into the furnace chamber.

Typically, the parts are loaded onto a flat plate or into a box type carrier, conventionally called the coffin, which is positioned within the furnace chamber. For large metallurgical furnaces, the coffin together with the parts often times weighs in excess of one thousand pounds.

In order to load the coffin into these previously known furnaces, it has been the previous practice to utilize a highlo truck to both lift the coffin and place the coffin within the furnace chamber. A primary disadvantage of this previously known practice is that a relatively large amount of clearance must be provided along both the sides and top of the furnace chamber. This clearance is required to provide sufficient handling room for the highlo truck as well as a vertical clearance to both lift and lower the coffin within the furnace chamber. Unless sufficient clearance is provided, the furnace would be damaged by the truck and/or coffin.

A primary disadvantage of the necessity of providing both vertical and horizontal clearance space within the furnace chamber is that it increases the overall volume of the chamber with unnecessary and unused space. The increased volume of the furnace chamber in turn increases the power of consumption for the furnace by the cube of the increased volume.

SUMMARY OF THE PRESENT INVENTION

The present invention provides a coffin delivery system which overcomes all the above mentioned disadvantages of the previously known delivery system for metallurgical furnaces.

In brief, the coffin delivery system of the present invention comprises a plurality of rollers which are secured to the bottom of the furnace chamber so that the axis of the rollers extends transversely with respect to the axis of the furnace chamber. In use, the coffin is placed on the rollers so that the rollers frictionally engage the bottom of the coffin and guide the coffin into the furnace chamber.

In the preferred form of the invention, the coffin includes at least one elongated channel along its bottom which registers with the rollers so that the rollers are positioned in the coffin channels. These channels thus guide the coffin as it is loaded into or unloaded from the furnace chamber thus effectively eliminating the need for any side or vertical clearance in the furnace chamber. The rollers are preferably constructed from graphite or consolidated carbon.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
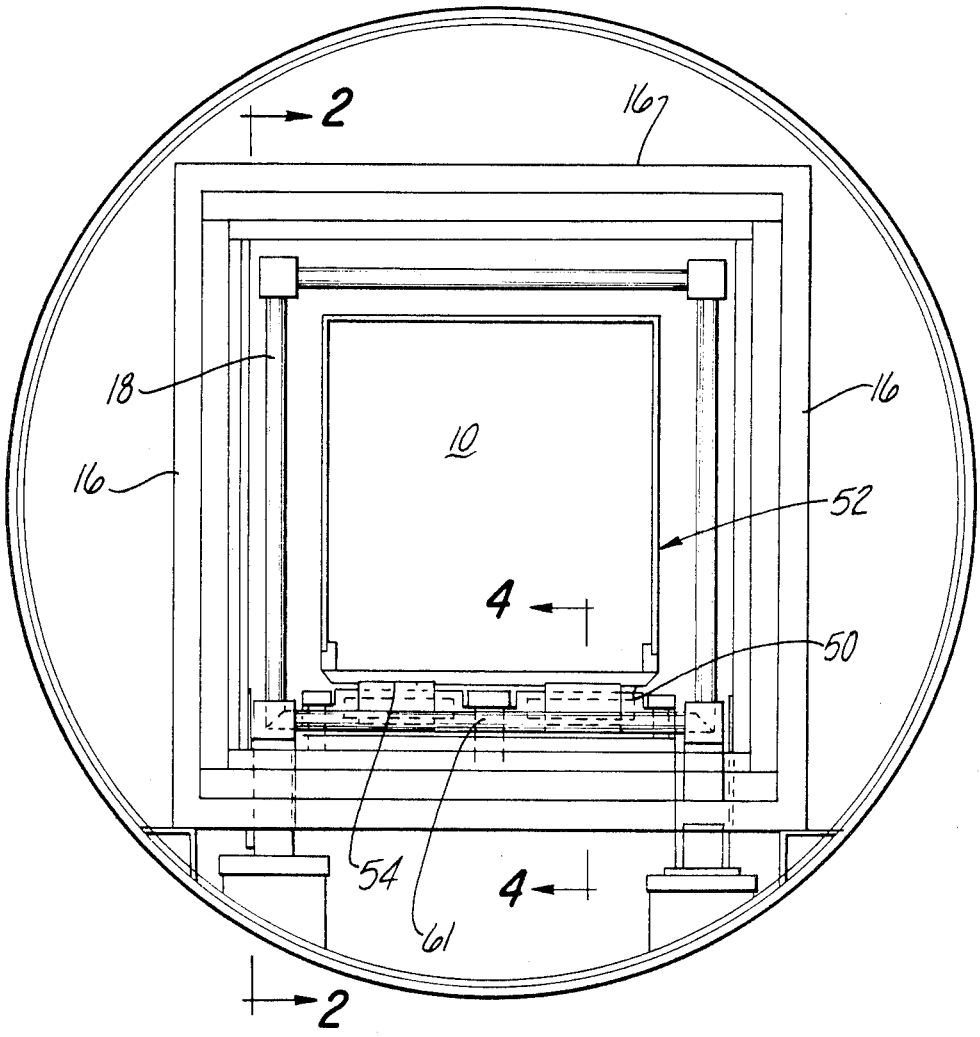
FIG. 1 is an end view illustrating a preferred embodiment of the present invention and with parts removed for clarity.
Figure 2:
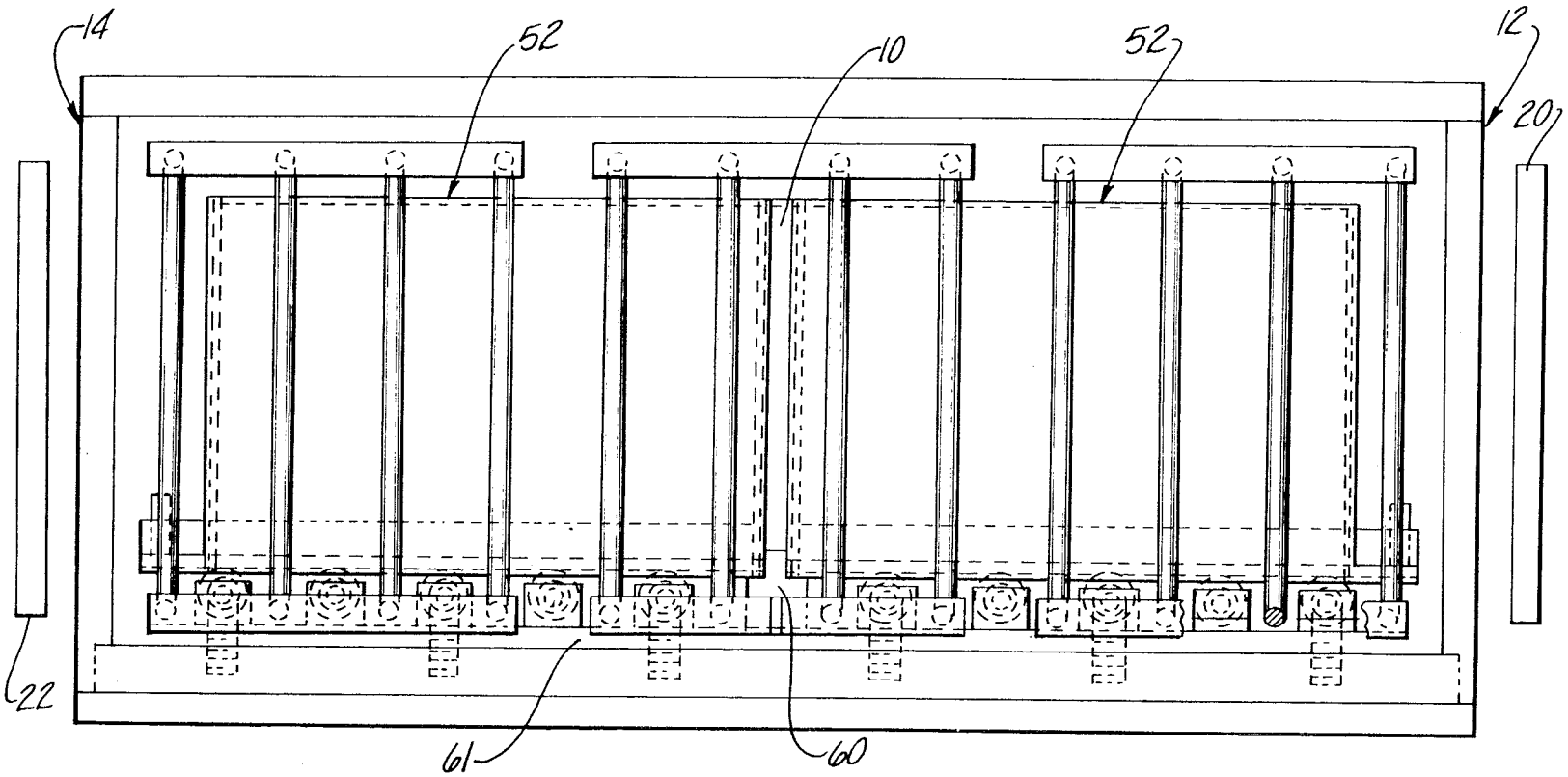
FIG. 2 is a view taken substantially line 2—2 in FIG. 1 and with parts removed for clarity.

With reference first to FIGS. 1 and 2, a portion of a metallurgical furnace is thereshown having an elongated furnace chamber 10 which is generally square in cross-sectional shape and open at each end 12 and 14. Conventionally, the furnace chamber 10 is surrounded by insulation panels 16 while one or more heating coils 18 are positioned within the furnace chamber 10 and closely adjacent the insulation panels 16. The heating coils 18 will be subsequently described in greater detail. In addition, a first door or hatch 20 provides access to one end 12 of the furnace chamber 10 while a second hatch 22 provides access to the other end 14 of the furnace chamber 10.

Figure 3:
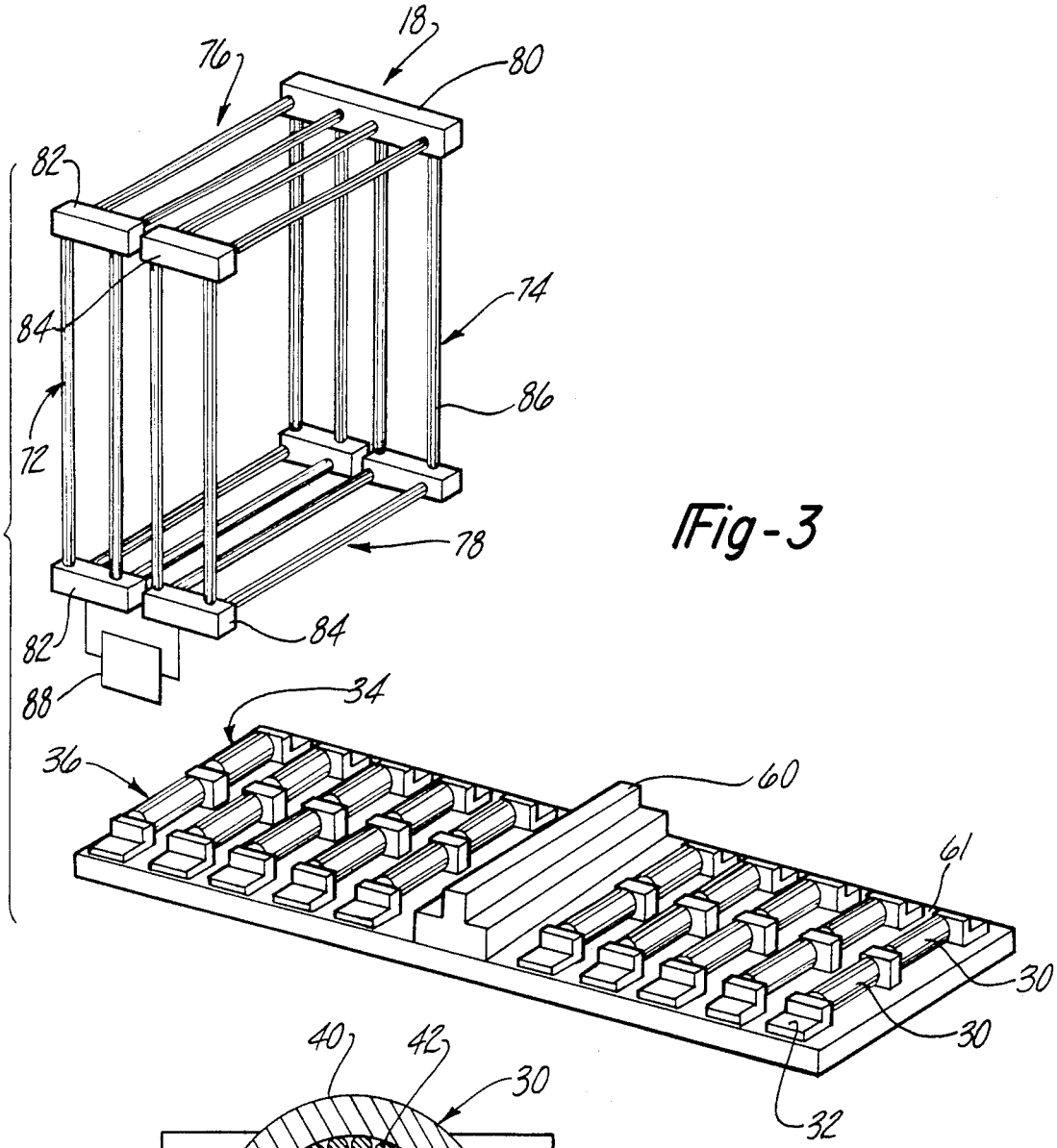
FIG. 3 is an exploded perspective view illustrating the preferred embodiment of the present invention and with parts removed for clarity.

With reference now to FIGS. 1–3, a plurality of cylindrical rollers 30 are rotatably mounted to the bottom of the furnace chamber 10 by roller mounts 32. The rollers 30 are preferably arranged in two longitudinally extending rows 34 and 36 so that the rollers 30 in each row 34 and 36 are spaced apart and parallel with respect to each other. In addition, the rollers 30 in one row 34 are coaxial with the rollers 30 in the other row 36 so that the axis of each roller 30 is tranverse with respect to the longitudinal axis of the furnace chamber 10.

Figure 4:
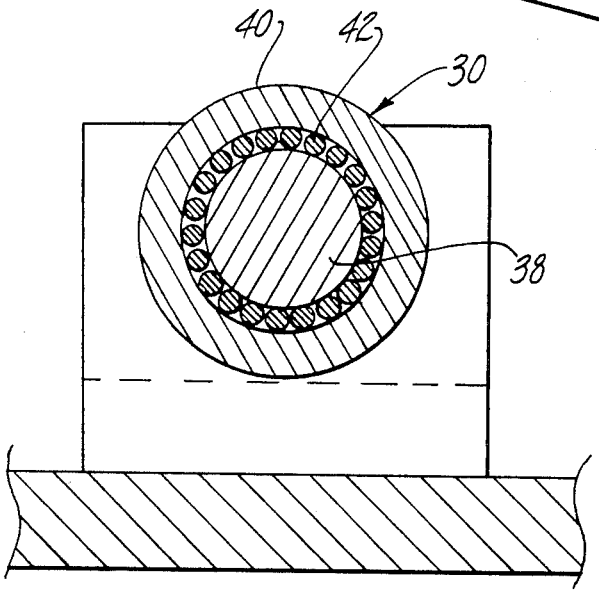
FIG. 4 is a cross-sectional view taken substantially along line 4—4 in FIG. 1 and enlarged for clarity.

With reference now particularly to FIG. 4, although the rollers 30 can be of any conventional construction, in the preferred form of the invention, each roller 30 includes a cylindrical axle 38 which extends between and is secured to the roller mounts 32. A tubular and cylindrical tube 40 is positioned coaxially around and spaced radially outwardly from the shaft 38 while cylindrical roller bearings 42 are positioned in between the axle 38 and roller tube 40 so that the tube 40 freely rotates with respect to the axle 38. The axle 38, roller bearings 42 and roller tube 40 are all constructed of a high temperature deformation resistant material, such as graphite or consolidated carbon. Such a material is necessary since the rollers remain within the furnace chamber during the heat treating metallurgical process.

With reference now particularly to FIGS. 1 and 2, the rollers 32 are adapted to frictionally engage the bottom 50 of a carrier or coffin 52 in which the parts to be heat treated are contained. The coffin 52 is generally conventional in construction except that it includes two upwardly extending longitudinal channels 54 formed in its bottom 50. Each channel 54 registers with one row 34 or 36 of the rollers 30 so that the portion of the rollers 30 are positioned within the channels 54. Thus, in use, the rollers 30 rotatably support and guide the coffin 52 into the interior of the furnace chamber 10.

With reference now particularly to FIGS. 2 and 3, preferably and upwardly extending stop 60 is secured to a midpoint of the furnace bottom so that the stop 60 extends transversely across the bottom. The stop 60, together with the dual access doors 20 and 22 enable one coffin 52 to be loaded into the furnace chamber 10 from each end. The stop 60 is dimensioned so that it abuts against the inner end of each coffin 52 thus limiting the extension of the coffins 52 into the furnace chamber 10.

With reference now to FIGS 1–3, preferably three heating coils 18 are positioned within the furnace chamber and closely adjacent the insulation panels 16. Each heating coil 18 is generally rectangular in shape and includes two sides 72 and 74, a top 76 and a bottom 78. A unitary bus bar 80 is positioned at the corner between the side 74 and top 76 while a bus bar containing two seperated parts 82 and 84 is provided at each other corner of the heating coil 18.

As best shown in FIG. 3, a pair of heating rods 86 extend between and are connected with each registering pair of bus bar parts 82 or 84 or with the unitary bus bar 80. A source of electrical power is interconnected between the bus bar parts 82 and 84 at the corner of the heating coil 18 which is diagonal from the unitary bus bar 80. Consequently, electrical power from the source 88 first flows through the heating rods 86 which interconnect the bus bar parts 82 to the bus bar 80. From the bus bar 80, the current flows through the heating rods 86 which interconnect the bus bar parts 84 and back to the power source 88.

The construction of the heating coil 18 is advantageous in several different respects. First, since the heating rods 86 extending along the sides 72 and 74, top 76 and bottom 78 of the heating coil are equal in length, the electrical current is equally distributed or balanced in each heating rod 86 thus providing a uniform temperature for each heating rod 86 and thus a uniform temperature for the furnace chamber 10. Furthermore, since only two heating coils 86 extend in between the bus bar parts 82 or 84 and/or the unitary bus 80, any thermal distortion of the heating coil 18 caused by thermal expansion of the heating rods 86 will be compensated for automatically. This automatic compensation may result in slight twisting of the parallelogram formed by a pair of heating rods 86 and the bus bar parts 82 or 84 but otherwise will not damage the heating coil.

Having described my invention, it is apparent that the present invention provides a unique coffin delivery system for a metallurgical furnace. Since the rollers automatically guide the coffin into the interior of the furnace chamber, only a very small clearance between the coffin and the heating coils 18 is required.

A still further advantage of the present invention is the provision of the heating coil 18 which allows the electrical power source to be connected between two adjacent bus bar parts 82 and 84 at the bottom of the furnace chamber and still obtain an automatic balance of the electrical current through the heating rods 86. A still further advantage of the heating coil of the present invention is that slight thermal distortion of the heating coil does not damage the heating coil.

Having describing my invention, however, many modifications thereto will become apparent to those skilled in the art to which it pertains without deviation from the spirit of the invention as defined by the scope of the appended claims.

I claim:

1. A heating coil for a metallurgical furnace comprising:

three sets of bus bar parts, each set comprising two aligned bus bar parts, a unitary bus bar having a length substantially equal to the length of one set, said sets and said unitary bus bar being spaced apart and parallel to each other and forming a parallelogram, a pair of heating rods extending between each bus bar part and its aligned bus bar parts or unitary bus on its adjacent corners, and means for connecting a source of electrical power to the bus bar parts on the set diagonal from the unitary bus.

* * * * *